US007097747B1

(12) United States Patent
Herceg et al.

(10) Patent No.: US 7,097,747 B1
(45) Date of Patent: Aug. 29, 2006

(54) CONTINUOUS PROCESS ELECTROREFINER

(76) Inventors: Joseph E. Herceg, 1421 Briarwood Dr., Naperville, IL (US) 60540; James G. Saiveau, 8936 S. 82 nd. Ave., Hickory Hills, IL (US) 60457; Lubomir Krajtl, 1205 Hastings, Woodridge, IL (US) 60517

( * ) Notice: Subject to any disclaimer, the term of this patent is extended or adjusted under 35 U.S.C. 154(b) by 398 days.

(21) Appl. No.: 10/637,088

(22) Filed: Aug. 5, 2003

(51) Int. Cl.

| | |
|---|---|
| ***C25C 7/00*** | (2006.01) |
| ***C25C 7/06*** | (2006.01) |
| ***C25C 7/08*** | (2006.01) |
| *C25C 3/34* | (2006.01) |

(52) U.S. Cl. ..... 204/201; 204/202; 204/213; 204/243.1; 204/247.2

(58) Field of Classification Search ..... None
See application file for complete search history.

(56) References Cited

U.S. PATENT DOCUMENTS

| | | | | | |
|---|---|---|---|---|---|
| 2,099,873 | A | * | 11/1937 | Sternfels | 205/74 |
| 3,642,605 | A | * | 2/1972 | Chenel et al. | 204/649 |
| 3,922,231 | A | * | 11/1975 | Carlin et al. | 205/557 |
| 3,981,960 | A | | 9/1976 | Brambilla et al. | |
| 4,025,400 | A | * | 5/1977 | Cook et al. | 205/74 |
| 4,092,397 | A | | 5/1978 | Brambilla et al. | |
| 4,204,922 | A | * | 5/1980 | Fraser et al. | 205/352 |
| 4,297,174 | A | | 10/1981 | Brambilla et al. | |
| 4,331,525 | A | * | 5/1982 | Huba et al. | 204/553 |
| 4,399,108 | A | | 8/1983 | Krikorian et al. | |
| 4,588,485 | A | * | 5/1986 | Cohen et al. | 205/398 |
| 4,740,359 | A | | 4/1988 | Hadi Ali et al. | |
| 4,874,507 | A | * | 10/1989 | Whitlock | 204/553 |
| H857 | H | * | 12/1990 | Haas | 205/47 |
| 5,009,752 | A | | 4/1991 | Tomczuk et al. | |
| 5,085,834 | A | | 2/1992 | LeMaire et al. | |
| 5,106,467 | A | * | 4/1992 | Leeker et al. | 205/347 |
| 5,132,092 | A | | 7/1992 | Musikas et al. | |
| 5,372,794 | A | | 12/1994 | LeMaire et al. | |
| 5,443,705 | A | | 8/1995 | Miller et al. | |
| 5,516,411 | A | * | 5/1996 | Kotowski et al. | 204/208 |
| 5,531,868 | A | | 7/1996 | Miller et al. | |
| 5,650,053 | A | | 7/1997 | Gay et al. | |
| 6,365,019 | B1 | * | 4/2002 | Herrmann et al. | 204/272 |
| 6,911,134 | B1 | * | 6/2005 | Dees et al. | 205/43 |
| 2004/0134785 | A1 | * | 7/2004 | Gay et al. | 205/46 |

FOREIGN PATENT DOCUMENTS

| | | | |
|---|---|---|---|
| JP | 10-53888 | A * | 2/1998 |

* cited by examiner

*Primary Examiner*—Harry D Wilkins, III
(74) *Attorney, Agent, or Firm*—Joy Alwan; Mark P. Dvorscak; Paul A. Gottlieb

(57) ABSTRACT

A new device is provided for the electrorefining of uranium in spent metallic nuclear fuels by the separation of unreacted zirconium, noble metal fission products, transuranic elements, and uranium from spent fuel rods. The process comprises an electrorefiner cell. The cell includes a drum-shaped cathode horizontally immersed about half-way into an electrolyte salt bath. A conveyor belt comprising segmented perforated metal plates transports spent fuel into the salt bath. The anode comprises the conveyor belt, the containment vessel, and the spent fuel. Uranium and transuranic elements such as plutonium (Pu) are oxidized at the anode, and, subsequently, the uranium is reduced to uranium metal at the cathode. A mechanical cutter above the surface of the salt bath removes the deposited uranium metal from the cathode.

16 Claims, 4 Drawing Sheets

CONTINUOUS PROCESS ELECTROREFINER

CONTRACTUAL ORIGIN OF INVENTION

The United States Government has rights in this invention pursuant to Contract No. W-31-109-ENG-38 between the U.S. Department of Energy and the University of Chicago, representing Argonne National Laboratory.

BACKGROUND OF THE INVENTION

1. Field of the Invention

This invention relates to a continuous process electrorefiner, and more specifically, this invention relates to an improved continuous process electrorefiner for recycling components of spent metallic nuclear fuel, such as uranium.

2. Background of the Invention

Uranium is the naturally-occurring material upon which conventional nuclear power is based. When the fissile uranium-235 isotope absorbs a neutron, fission occurs, with the liberation on average, of approximately 2.5 neutrons. Some of these neutrons are used to bombard more uranium, while other of these neutrons are used to create plutonium (Pu) by the reaction:

$$^{238}U + ^{1}n \rightarrow ^{239}U \rightarrow ^{239}Np \rightarrow ^{239}Pu$$

and subsequently fission some of it. The energy of fission fragments is used to heat water, gas, or liquid metal. These heated fluids in turn are used to spin electric-generating turbines.

Uranium is scattered in deposits throughout the world. Further, its total supply is not known. The efficiency of use of the energy locked up in uranium can be very low. Approximately one to two percent of the energy content of uranium is tapped in uranium-235-based nuclear power systems. The remaining 98 to 99% of the energy content of uranium is present as uranium-238 which can be converted into fissionable plutonium-239 via neutron bombardment in breeder reactors. Otherwise, "spent" metallic uranium fuel, i.e., having little uranium-235, and the bulkiness of the materials associated with that "spent" fuel present storage and disposal problems.

Current United States policy is to store unprocessed spent reactor fuel in a geologic repository. Long-term uncertainties are hampering the acceptability and eventual licensing of a geologic repository for spent nuclear fuel in the U.S., and driving up its cost. The resistance among Yucca Mountain Range residents and others regarding plans to deposit radioactive material in the Yucca Mountain Repository is a case in point.

Instead of long term storage of untreated radioactive materials, preliminary treat-ment of spent nuclear fuel is being explored, including partial utilization of the fissile material contained in the spent fuel via conversion to plutonium-239 in breeder reactors. Accordingly, there is an emphasis upon developing new technologies for reprocessing and reutilizing spent nuclear fuels.

A number of processes exist for the processing and recycling of nuclear fuels. These processes often involve aqueous solutions. Due to the presence of water, aqueous solutions are neutron moderators. This is because collisions between water nuclei and neutrons, which are initially created by the spontaneous fission of plutonium, lowers the neutrons' kinetic energies. This lower energy increases the likelihood of the neutrons inducing more fission upon their collision with the plutonium nuclei remaining in the fuel. Thus, previously innocuous levels of plutonium now become potential run-away fission hazards. This lowered critical mass necessitates the use of very low plutonium concentrations and redundant safeguards to assure fission control. Lower plutonium throughputs result. Aqueous solution processing and recycling of nuclear fuels is generally inefficient and not cost-effective.

Research in pyrometallurgical processing of spent metallic nuclear fuel continues for reducing both the radiotoxicity and the volume of waste from commercial nuclear power generation. This is especially true when such pyrometallurgical processing is combined with either a reactor-based or accelerator-driven actinide burner. A major step in this process is the electrorefining and separation of uranium, the major heavy metal component of the spent fuel, from the higher actinides such as plutonium, so that the latter may be fabricated into new fuel assemblies for insertion into the reactor-driven or accelerator-driven burner.

Interest in recent years has focused on electrorefining the large inventories of blanket fuel and other spent metal fuels at DOE sites such as the approximately 25 metric tons stored at the Experimental Breeder Reactor Two (EBR-II) at Argonne National Laboratory-West in Idaho. (Blanket fuel contains primarily uranium-238, a non-fissile isotope that a reactor converts to fissionable plutonium. The blanket fuel is encased in steel cladding and is situated beyond the reactor core's outer edge and thus forms a "blanket" around the core. The name has also been given to similar assemblies located within the plutonium-fueled driver core.)

A current method in the art for electrorefinement of these spent metallic nuclear fuels is a circular batch processor. Generally, these processors have a small throughput.

The typical electrorefiner consists of a hollow cathode, about 10 inches in diameter and about 10 inches in height. Anode baskets are attached to a central spindle and designed to rotate coaxially and within the center of the cathode. Several of these anode/cathode assemblies or modules are located within a larger container of electrolytic salt.

FIG. 1 depicts a cross-sectional view of such a design, designated generally as numeral 10. In this design 10, depleted nuclear fuel is loaded into anode baskets (all of approximately the same volume) 12, made of ferrous metals, that rotate in two channels 14. Each anode basket 12 has a bus bar 16 which serves as a metal spine for the anode basket 12. The baskets are positioned between cylindrical cathode tubes 18. The anode basket assembly 12 is attached to a circular plate and a central spindle (not shown) which are located above the baskets. Current flows from the circular plate to the bus bars 16 which distribute the current to and through the anode baskets 12. The anode assembly 12 and the cathode tubes 18 are submersed in a molten LiCl—KCl eutectic (not shown) which is situated in the channels 14. The salt also contains 2 to 3 mole (mol) % uranium as uranium (III) $U^{3+}$ cations, provided by adding $UCl_3$ to the salt.

Uranium and the elements in the fuel that are less noble than uranium are oxidized at the anode baskets 12 ($U^0$ to $U^{+3}$) and form cationic species that dissolve in the molten salt. Zirconium (Zr) and noble metal fission products, such as molybdenum (Mo), ruthenium (Ru), palladium (Pd), platinum (Pt), and rhodium (Rh), remain in the anode baskets 12 inasmuch as the optimal applied voltage is too low to ionize these metals. Gaseous fission products escape and rare earth metal fission products dissolve in the molten eutectic and remain there. The molten salt is eventually cleaned.

Uranium cations, liberated at the anode, migrate to and are then reduced by the cathode 18 and deposited thereon. Scrapers 20 which form part of the bus bars 16 dislodge the electrodeposited uranium, which then falls into a collection basket (not shown) positioned inferior to a depending or bottom region of the outer cathode tube 18. Since the scrapers 20 are immersed in the eutectic salt bath and contact the anode 12, cathode 18, and the bus bar 16, they are usually made of an insulating ceramic material such as beryllia (beryllium oxide, BeO).

This system 10 experiences frequent binding and consequent stalling of the rotation drives, partially due to the buildup of a lumpy product containing residual unrefined salt. This salt must be boiled off in a Cathode Processor. These binding problems are due to holdup of material in the narrow annular regions between the rotating segmented cylindrical anodes 12 and surrounding cathodes 18 of the electrode modules. These narrow annular regions cannot be widened, otherwise, the efficiency-robbing resistance will increase between the anode and cathode. As a result of this state of the art design, only a small throughput of metal product is realized.

This typical system 10 requires a high anode 12 surface-to-volume ratio so as to maximize electrochemical efficiency. This requirement inherently constrains the vertical anode fuel-bed baskets 12 to small sizes since they can be enlarged easily only in the vertical length-wise, or load and unload, direction.

Product collection is done at the bottom of the electrode assembly and allows for undesirable contaminants such as fission product particulates to fall into a collection basket along with the uranium product.

At the present time, no continuous and efficient, high throughput process exists for the processing and treatment of metallic spent nuclear fuels.

U.S. Pat. No. 5,650,053 awarded to Gay, et al. on Jul. 22, 1997 discloses a process and device for the electrorefining of spent metallic nuclear fuels. The device has parallel electrodes with anode baskets rotating within a cylindrical cathode.

U.S. Pat. Nos. 5,531,868 and 5,443,705 awarded to Miller, et al. on Jul. 2, 1996, and on Aug. 22, 1995, respectively, disclose processes and devices for the electrorefining of uranium and plutonium.

U.S. Pat. No. 5,372,794 awarded to LeMaire, et al. on Dec. 13, 1994 discloses a process for separation of actinides from aqueous solutions.

U.S. Pat. No. 5,132,092 awarded to Musikas on Jul. 21, 1992 discloses an aqueous process for the extraction of uranium (VI) and plutonium (IV).

U.S. Pat. No. 5,085,834 awarded to LeMaire, et al. on Feb. 4, 1992 discloses an aqueous method for separating plutonium from uranium and from fission products.

U.S. Pat. No. 5,009,752 awarded to Tomczuk, et al. on Apr. 23, 1991 discloses a process and device for the electrorefinement of spent metallic nuclear fuel in the form of steel-clad metal pins containing 90% uranium and 10% zirconium (Zr).

U.S. Pat. No. 4,740,359 awarded to Hadi Ali, et al. on Apr. 26, 1988 discloses an organic-aqueous process for recovering uranium values.

U.S. Pat. No. 4,399,108 awarded to Krikorian et al. on Aug. 16, 1983 discloses a carbothermic reduction method for the recovery of actinides.

U.S. Pat. No. 4,297,174 awarded to Brambilla on Oct. 27, 1981 discloses a pyroelectrochemical process for reprocessing irradiated nuclear fuels. The process involves dissolving fuel to be reprocessed in a fused-salt bath.

U.S. Pat. No. 4,092,397 awarded to Brambilla, et al. on May 30, 1978 discloses a method for the pyrochemical separation of plutonium from irradiated nuclear fuels, by thermal decomposition in molten nitrates.

U.S. Pat. No. 3,981,960 awarded to Brambilla, et al. on Sep. 21, 1976 discloses a reprocessing method of ceramic nuclear fuel in low-melting nitrate molten salts.

Several of these patents teach aqueous separation processes which are less than efficient. Other patents amongst these do not disclose a method for the electrorefining of metallic nuclear fuels. Also, none of the aforementioned patents disclose either a process or apparatus to counter the aforementioned difficulties, including the low throughput of refined uranium metal. Further, none of the aforementioned patents anticipate or suggest continuous, uninterrupted electrochemical oxidation and reduction of uranium.

A need exists in the art for an improved method and device for isolating uranium metal from elements of spent metallic nuclear fuel. The method should not require aqueous separation techniques. The method and device should directly and continuously separate uranium metal from the transuranics and noble metal fission products present in the spent metallic fuel. In addition, the method and device should have a much higher throughput of refined uranium metal than present uranium electrorefiners.

SUMMARY OF INVENTION

An object of the present invention is to provide a method of efficiently processing and recycling uranium from spent nuclear fuels that overcomes many of the disadvantages of the prior art.

Another object of the present invention is to provide a nonaqueous system for the recovery of metal values from spent nuclear fuel rods. A feature of the invention is that the spent fuel rods are placed in a metal anode basket and uranium is recovered by direct electrochemical action. An advantage is that costs are lowered due to the reduction of steps necessary to recover the target metal.

Still another object of the present invention is to provide a method for the recovery of uranium metal by electrowinning in a molten electrolyte bath of alkali metal chlorides and uranium chlorides. A feature of the invention is that uranium metal ions emanating from the anode replace the ions in the melt which in turn discharge at the cathode, forming the metal. An advantage of the invention is that the reduced uranium metal is collected directly from the cathode in concentrated form.

Yet another object of the present invention is to provide a method for the continuous processing of spent nuclear fuels. A feature of the invention is that spent nuclear fuel is continuously fed into the process, while product is simultaneously isolated and removed. An advantage of this feature is that unwanted materials from the spent fuel stream are isolated from the uranium at a point inferior to the gravity-induced uranium product collection point, therefore assuring purer uranium product. Another advantage is that downtime needed for feed replenishment and product/debris removal are eliminated and costs are lowered.

It is still another object of the present invention to provide a device and method for separating uranium metal from transuranic metals, alkali, alkaline earth, rare earth, and noble metal fission products. A feature of the invention is that elemental uranium metal is extracted from spent metallic nuclear fuel substrate at temperatures well below zirconium's melting point, 1852° C., and below the melting points of fission product noble metals. An additional feature is that the extraction of uranium metal from the substrate takes place at reduction potentials below those of zirconium and the noble metals. As such, the transuranic metals and other metals present in the spent fuel rods accumulate in the chloride bath as oxidized metal. An advantage of these features is that solid phase uranium metal of high purity is isolated on the cathode while the other metals remain in solution. Thus, both electrostatic and mechanical-collection processes simultaneously keep unwanted spent fuel materials from contaminating the isolated target metal product.

Another object of the present invention is to provide a device for maximized collection of refined uranium metal. A feature of the invention is that the removal of dendrite uranium metal crystals from the cathode drum takes place at a point remote from the salt bath. An advantage of this feature is that it minimizes salt carryover to yield a purer refined uranium metal of granular consistency and high packing density, all resulting in a lowering of product processing volume and time, thus reducing costs.

Still another object of the present invention is to provide a device that allows for faster collection of refined uranium metal. A feature of the invention is that the scraper which removes the uranium metal from the cathode is located remote to any hot salt baths. Thus, the scraper can be made of sharpened tool steel, or even silicon carbide (SiC) or tungsten carbide (WC). An advantage of this feature is that the removal of the uranium is more effective and efficient and results in even lower costs.

Yet another object of the present invention is to provide a device that further insures high purity uranium metal. A feature of the invention is that the cathode rotates, opposite to the direction of net anode belt movement, so that the dendrites collected on the cathode's circumferential surface are carried out of the salt bath. Another advantage of this feature is that the counter rotating cathodes and anodes optimize collection efficiency and dendrite removal, thus avoiding the buildup of product in the gap between the electrodes. Another advantage is that the system is shut down less frequently, resulting in lower costs.

Still another object of the present invention is to provide a device that can be adapted to different production output needs. A feature of the invention is that loading of the fuel is carried out from above the shallow anode compartments on the moving belt along the belt's smaller horizontal dimension. In addition, the anode belt is thin and in close proximity to the cathodic drum. An advantage of these features is that they allow for straightforward scaleability of the electrorefiner design to larger sizes for the other transverse or perpendicular dimensions.

Briefly, the invention provides a process for separating uranium and transuranic metals from spent nuclear fuel and refining the uranium to its metallic state, the process comprising continuously transporting spent fuel to and through a molten electrolyte salt bath; oxidizing the transported uranium and transuranic metals at an anode; reducing the oxidized uranium ions to metallic uranium at a cathode; and removing the metallic uranium from the cathode.

The invention also provides a device for the electrorefining of uranium and other metals contained in spent metallic nuclear fuels, the device comprising a means for oxidizing the uranium and other metals; a means for continuously transporting spent metallic nuclear fuel to the oxidizing means; a means for reducing uranium (III), $U^{3+}$, ions while keeping the other metals oxidized; a means for isolating the reduced uranium from the other metals; and a means for receiving inert material remaining after the oxidation and reduction.

BRIEF DESCRIPTION OF DRAWING

The invention together with the above and other objects and advantages will be best understood from the following detailed description of the preferred embodiment of the invention shown in the accompanying drawing, wherein.

DETAILED DESCRIPTION OF THE INVENTION

The instant invention provides a device and process for the isolation and recovery of materials homogeneously dispersed in a substrate. Specifically, this invention provides a device and a process for processing spent nuclear fuel typically presented as spent fuel rods. The invention comprises an electrorefiner which allows for direct, and most importantly, continuous and uninterrupted electrochemical processing of spent metallic nuclear fuels containing uranium, transuranic metals, zirconium, and a mixture of rare earth metals, gases and other metals which result as fission products. Further, the instant invention isolates uranium from the other metals present in the spent metallic nuclear fuel matrix, and simultaneously purifies the uranium into its metal phase. The device embodying the invention is self-cleaning.

Figure 2:
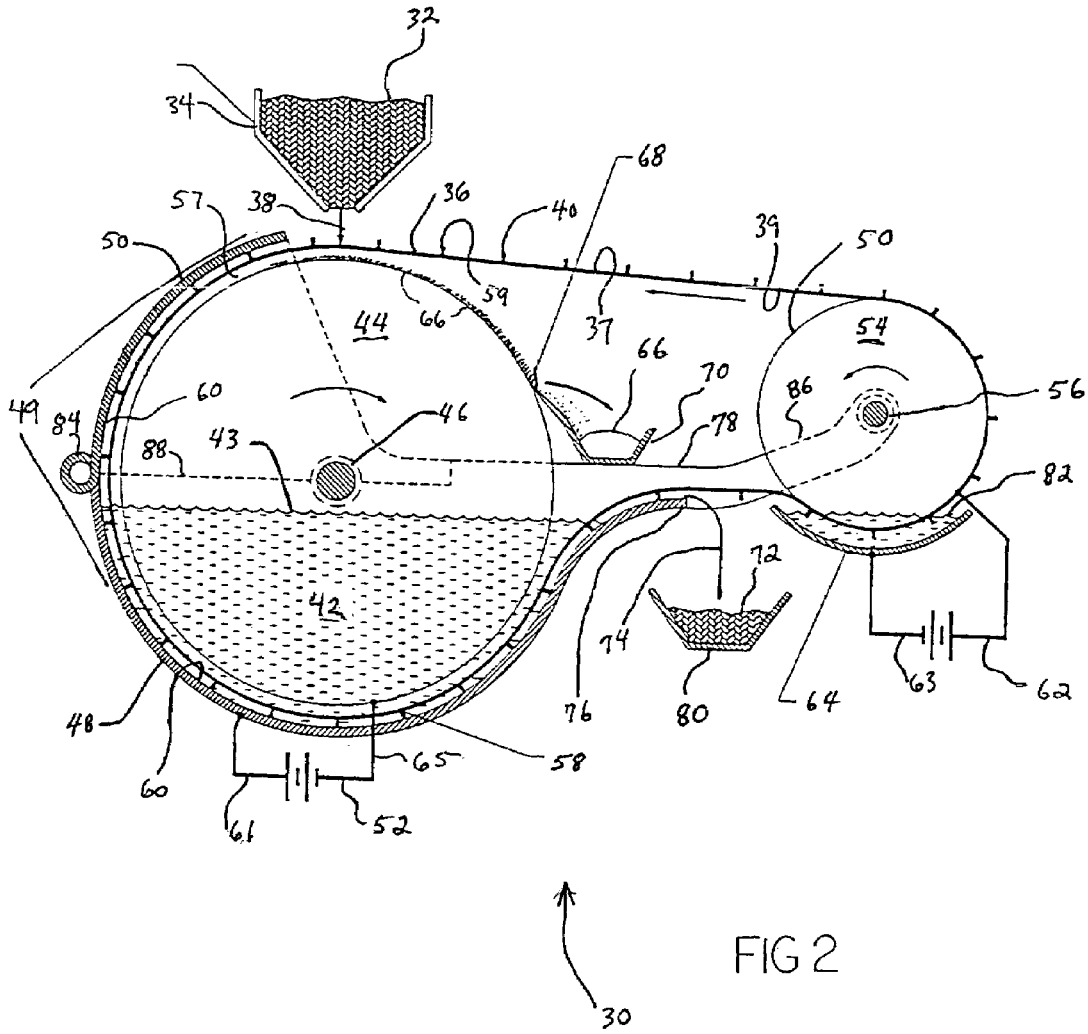
FIG. 2 is the schematic diagram of an exemplary uranium refinement and collection system, in accordance with features of the present invention.

A schematic diagram of an exemplary device and process is depicted in FIG. 2 as numeral 30. This device 30 can be located in situ or off-site from the point where fissionable material is utilized. An obvious practical application of the invention is the reprocessing of nuclear fuel. In this scenario, a supply of spent nuclear fuel serves as the reactive substrate. The spent fuel 32 is shredded or finely chopped and subsequently subjected to an electrolytic process. The process reduces uranium ions such as $U^{3+}$ and simultaneously oxidizes radioactive heavy metals still present in spent fuels such as uranium, and transuranics such as plutonium and other actinide elements, but not the noble metal fission products.

The invention provides a uranium refinement and collection system which is situated in a controlled, typically heated, nonoxidizing atmosphere, such as an atmosphere of argon, helium or combinations thereof. A preferred gas is argon. Very pure argon (Ar) (not more than ~10 parts per million (ppm) each of $H_2O$, $O_2$, and $N_2$) is particularly preferred. Such atmospheres prevent the formation of insoluble compounds of oxygen and nitrogen containing heavy metals (uranium and higher actinides) that otherwise cause loss of these metals.

As more thoroughly discussed infra, the invention designated as numeral 30 in FIG. 2 comprises a cylindrical cathode 44, horizontally mounted, and immersed about halfway into a salt bath 42 contained within a semi-cylindrical containment vessel 48. The salt bath is a standard LiCl—KCl eutectic salt bath with a small amount (~2 to 3 mol %, or 4 to 6 wt. %) of $UCl_3$ present in the bath. A segmented chain belt 36 with brush-tipped weirs 40, in electrical contact with the smooth interior of the salt containment vessel, carries shredded or finely chopped fuel 32 through the salt. The weirs are part of the hinge assemblies which give the belt flexibility.

The containment vessel, segmented chain belt, segment connectors (infra) and the shredded fuel serve as the anode. The brushes on the tips of the weirs serve to complete a first anodic electrical circuit via the brushes' contact with the inner surface of the containment vessel. The circuit also is established via the segmented chain belt, shredded fuel, and a drive sprocket 54 the last of which actuates the belt.

The segments of the chain belt are hingeably connected together (by, for example piano-type hinges). The longitudinally extending edges of the chain belt 41 and/or the hinge pins 45 (FIG. 3) are adapted to be received in tracks formed in the ends 51 of the semi-cylindrical containment vessel. This assures that an annular space 57 is maintained between the drum 44 and an opposing surface 39 of the belt so as to accommodate the build up of uranium metal deposited on the drum surface. There is also an annular space 53 between the belt 36 and the containment vessel 48.

Figure 3:
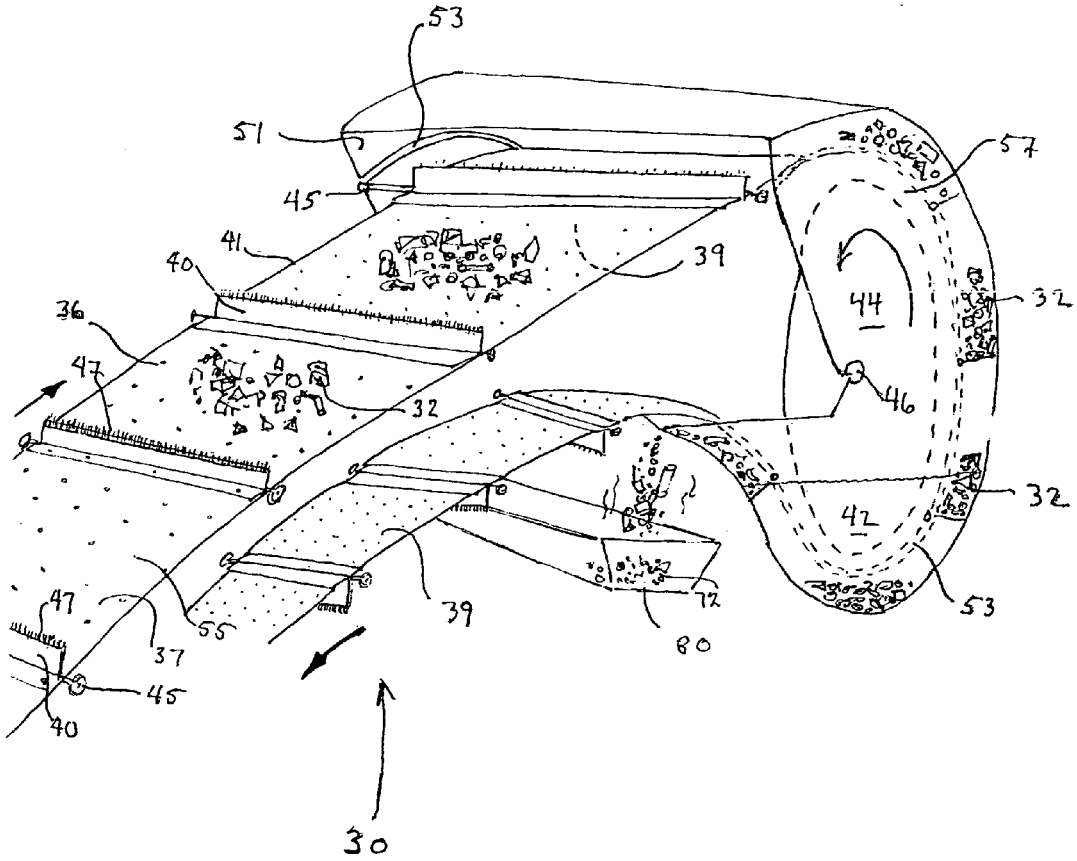
FIG. 3 is a perspective diagram of the transport mechanism of the invented collection system, in accordance with features of the present invention.

As depicted in FIG. 3, the flat segments of the belt are perforated 55, with a high degree of porosity, to allow passage of the heavy metal ions through the belt segments. A fine-mesh (200 mesh or finer) metal screen or equivalent composite, also containing a high degree of porosity, rests on and contacts the fuel-contacting side of the perforated segments. The fine-mesh screen 49 (FIG. 4) serves as a physical barrier to prevent noble metal fission products and the spent fuel matrix 32 (zirconium), in the form of sludge-like and particulate matter, from reaching the cathode.

Heaters external to the semi-cylindrical vessel maintain the temperature of the components of the device above the freezing point of the salt. Otherwise, the hinged belt segments would freeze and lock the segments together or else lock the belt to the drive sprocket.

The fine-mesh metal screen is subsequently cleaned, to prevent the screen from becoming opaque to the transmission of ions, by passing the segmented belt through a second salt bath which contains a LiCl—KCl eutectic melt. Zirconium and noble-metal fission products are then oxidized on the belt due to the close spatial relationship of the belt to an anodic drive sprocket maintained at a higher applied voltage than the voltage applied supra. The zirconium and noble-metal fission products are then reduced at the inner surface of a vessel containing the second salt bath, that vessel comprising a second cathode.

For both the oxidation/reduction of uranium, and the similar oxidation/reduction of zirconium and noble-metal fission products, each section of the moving belt that momentarily resides within the salt baths in each of the two different vessels forms an anode.

Uranium is reduced to the metal and forms as dendrites (crystalline tree-like structures) on the cathode drum 44. The cathode drum 44 rotates, opposite to the direction of net anode belt movement, so that the dendrites collected on its circumferential surface are carried out of the salt. Independent cathode and anode movement permits optimization of collection efficiency and dendrite removal, thus avoiding the buildup of product in the spatial gap between the electrodes.

The ends of the cathode drum are insulated to prevent deposition of uranium metal dendrites there. Removal of the dendrites, by a scraper 68, from the cathode drum at a point above the salt bath surface minimizes salt carryover and yields a product 66 that is granular and has a high packing density.

Cladding shards or hulls from the spent fuel are carried through the containment vessel by the weirs and discharged, along with any other inert material, over the lip of the vessel into another receptacle 80.

The main electrodeposition circuit contains a low-voltage, high-current, DC power supply 52, and is connected, via its positive electrode, to the containment vessel and, negative electrode, to the cathode collection surface, via the drum's axle or directly using brushes. A similar secondary electrodeposition circuit is connected, via its positive electrode, to the anodic drive sprocket, and, negative electrode, to the clean-up vessel. This configuration results in the chain belt 36 being anodic in both circuits, thereby allowing for a common terminal for two anodes in the device.

There is electrical communication between each anode and cathode in an anode-cathode pair and between each anode-cathode pair and their respective electrolytic salt baths. The electrolyte salt baths facilitate the electrical communication.

Device Detail

In the electrorefiner cell 30, the spent fuel 32 containing a plurality of metals is placed in a hopper 34 suspended over the segmented belt 36.

The spent fuel 32 passes through a means of egress 38 at a depending end of the hopper 34 and onto the belt 36.

Figure 4:
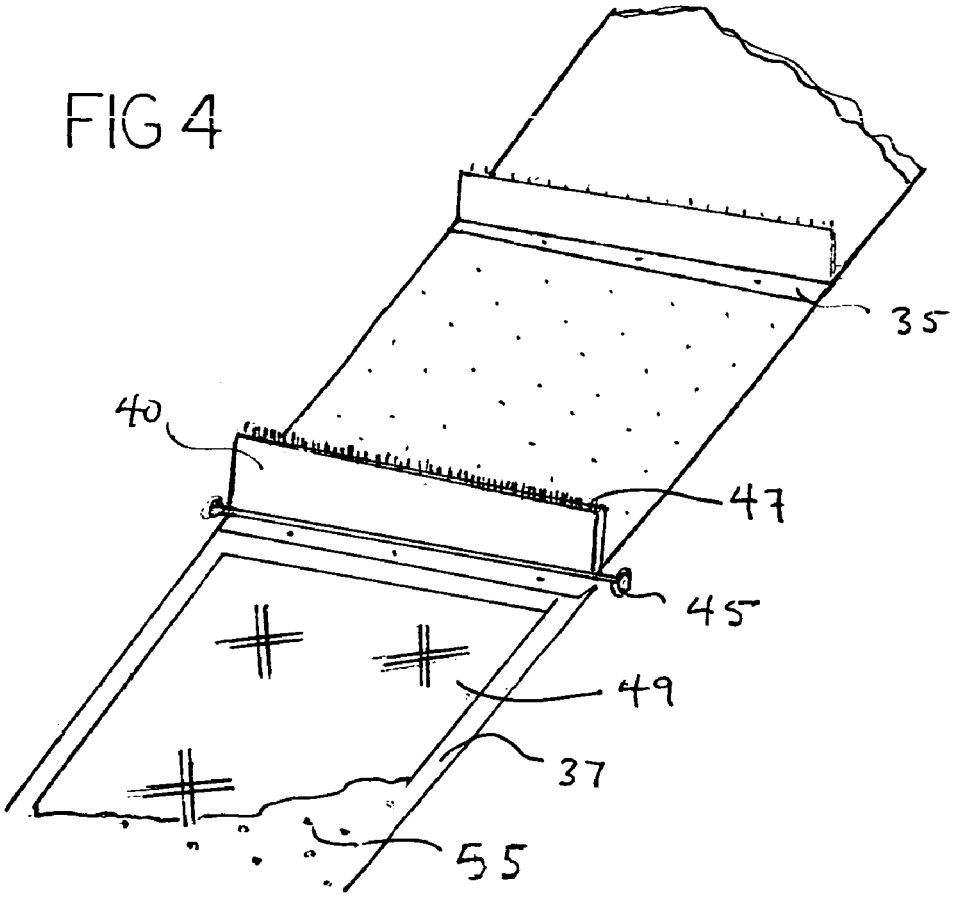
FIG. 4 is a schematic diagram of one section of the transport mechanism of the invented collection system, in accordance with features of the present invention.

As depicted in FIGS. 3 and 4, the belt contains weirs 40, which in turn comprise metal brushes 47 on their tips. The electrolyte 42 contains a LiCl—KCl eutectic mixture and uranium chloride, $UCl_3$.

The cathode 44, a metal drum, contacts a surface 43 of, and is partially immersed in, the molten electrolyte 42, and rotates on an insulated bearing 46 while contacting the molten electrolyte 42 in a first vessel 48. The first vessel 48 serves as containment for the molten electrolyte 42 and the cathode drum 44.

A first voltage 52 is applied between an anode 48, the first vessel, and a cathode 44. The first voltage 52 is applied via a positive electrode 61 of a first power supply 52 to the first vessel 48. A negative electrode 65 of the first power supply 52 is in electrical communication with the cathode collection surface 44. This mode of connection of the first power supply 52 makes the drum 44 cathodic and the first containment vessel 48 anodic. The overall anode 50 for the system 30 comprises the containment vessel 48, the drive sprocket 54 that rotates on another insulated bearing 56, the conveyer belt 36, and the spent fuel 32. Direct contact 58 of the weirs' brush tips 59 with the inner surface 60 of the first vessel 48 facilitates completion of the anodic electrical circuit.

In addition, a second voltage is applied by a second power supply 63 attached via its positive electrode 62 to the drive sprocket 54. Inasmuch as the drive sprocket 54 rotates, electrical connection can be effected via a hub 56 of the sprocket 54. A negative electrode 63 of the second power supply is in electrical communication with a second vessel 64. This mode of connection makes the drive sprocket 54 anodic, and the second vessel 64 cathodic, so as to define a second anode and a second cathode, respectively.

Positive current supply lines 61 and 62 connect indirectly to the conveyor belt 36 enabling the belt 36 to be an anode for both electrical circuits in the instant invention.

Initially, the electrorefiner cell 30 decomposes uranium metal to uranium (III), $U^{3+}$, and then reduces the $U^{3+}$ to uranium metal, according to Equations 1 and 2:

Equation 1 (First Anode 48): $U(s) \rightarrow U^{3+}(l) + 3e^-$

Equation 2 (First Cathode 44): $U^{3+}(l) + 3e^- \rightarrow U(s)$ wherein (s) designates solid phase and (l) designates liquid phase.

The $U^{3+}$ released by oxidation of an uranium metal atom at the first anode 48 (Eq. 1) replaces a $U^{3+}$ ion from the electrolyte salt bath 42 simultaneously reduced at the cathode 44. Essentially, the $U^{3+}$ is in electrical communication with the cathode 44, migrates through the melt 42 (towards the cathode 44) continually displacing or pushing forward the $U^{3+}$ already in the melt 42 and associated with chloride ion.

The displaced $U^{3+}$ is reduced upon contact with the cathode 44 to crystalline elemental metal 66 in the form of dendrites 66 (crystals with tree-like shapes). The elemental uranium dendrites 66 deposited on the cathode 44 are separated from the first cathode 44 by a scraper 68 and subsequently collected in a first receptacle 70. All inert debris 72, including the fuel cladding shards or hulls, are carried through the first containment vessel 48 by the weirs 40 and are discharged from the system 30 via an egress point 74. This egress point is defined by a longitudinally-extending lip 76 of the first containment vessel 48. A second receptacle 80 positioned inferior to the lip 76, serves to collect the detritus via gravity feed, negative pressure, or other collection means.

Belt Detail

The belt 36 defines a continuous, uninterrupted loop or substrate in close spatial relationship with the circumferential surface of the cathode drum 44. The belt is actuated by the drive sprocket 54. Generally, the sprocket rotates counter-clockwise, while the drum 44, under separate actuating means, rotates clockwise.

Radially facing surfaces of the belt (i.e., the surfaces of the belt which face away from the cathode 44) define transversely extending weirs 40, the weirs comprised of plate segments 33 (FIG. 4). These plate segments are electrically conductive. The segments are in hingeable relationship to each other. For example, in one embodiment, the segments are held together by piano-type hinges 35 (FIG. 4). The weirs 40 are an integral part of the hinge assemblies. The perforations on the belt 36 provide a means for uranium from the spent fuel stream to electrostatically migrate to the cathode drum 44 where a voltage potential exists between the drum 44 and the containment vessel 48.

A schematic diagram of an exemplary belt segment is depicted in FIG. 4. The segment 33 is depicted with a weir 40 vertical at one end of the plate segment with a bristle-containing brush tip 47 atop the weir 40. At the base of the weir 40 is a hinge 35 which serves as a flexible connection to adjoining plate segments (not shown). The bristles of each brush tip 47 are about ⅛ inch (in) or approximately 0.32 centimeter (cm) long. The primary purpose of the bristles of the brush tip 47 is to sweep the interior surface 60 of the first containment vessel 48.

A layer of fine-mesh screen (not shown) contacts the fuel side 37 of the belt 36. This screen along with the belt 36 is passed through a second salt bath 82 for cleaning of the belt 36. The second salt bath 82 is in close spatial relation to the drive sprocket 54 and contained within the second vessel 64. The second voltage 62 serves to oxidize the noble-metal fission products and zirconium remaining on the belt 36 as the belt 36 approaches the anodic drive sprocket 54 and enters into the second bath 82. The noble-metal fission products and the zirconium are subsequently reduced as dendrite crystals onto the inner surface of the cleanup vessel 64 which serves as the second cathode 64.

The second bath's salt 82 is drained from the clean-up vessel 64 periodically and the vessel 64 is removed and is either cleaned and reinstalled or is sent to a radioactive waste storage facility, along with the noble-metal/zirconium material deposited on the second vessel 64, and replaced.

The first cathode 44 is positioned above the first anode 48. Also, removal of the product from the portion of the cathode surface 44 occurs above the first salt bath level 43 in the first vessel 48. This arrangement prevents contaminants 72 from falling into the isolated uranium crystals 66.

Optimally, to facilitate manual cleanup, and inspection and/or removal of the cathode drum 44, a portion of the periphery 49 of the first vessel 48 is hingeably mounted, via a hinge 84, to the first vessel 48. This allows for the portion to be manipulated to provide unhindered access to the first cathode 44.

The dashed lines 86 in FIG. 2 represent one end 86 of a housing 78 of the system 30 which is below the plane of FIG. 2 (i.e., behind the end of the cathodic drum 44).

Motors and drive gears for both cathode drum 44 rotation, drive sprocket 54 rotation and belt 36 transport, as well as the electrical connection to the cathode drum 44 shaft 46, and to the anodic drive sprocket 54 and shaft 56 are standard rotating contacts, e.g., mercury or brush-and-slip-ring units, are located outside the oven (none of these shown in FIGS. 2–4).

The material comprising the anode baskets 36, the cathode 44, anodic drive sprocket 54, and the first vessel 48 and the second vessel 64 can be a heat tolerant (i.e. melting point (mp) temperature above the temperature of the salt baths) and salt-compatible material selected from the group consisting of low-carbon steel, ferritic stainless steel, stainless steel, and alloys thereof. The scraper 68 can be made of a material selected from the group consisting of tool steel, silicon carbide, and tungsten carbide.

The fine-mesh metal screen (or metal filter equivalent or a composite/mixture of filter and screen) is applied to the fuel side 37 of the perforated plates/anode baskets 36 can be 200 mesh or finer, and of the same material as the anode baskets 36. The screen serves as a physical obstacle to prevent sludge-like particulate matter containing zirconium and noble metal fission products from entering into the first salt bath 42.

To facilitate continuous and uninterrupted product generation, collection and removal, the product 70 and debris 80 receptacles supra can take the form of conveyor belts moving perpendicularly to the plane of FIG. 2 to discharge the materials into containers outside the heated region.

Further, the dendrite scraper 68 can define a small moving cutter traveling in a direction parallel to the longitudinal axis of the cathode drum 44 and perpendicular to the plane of FIG. 2 in a manner similar to the tool movement of a machine-shop shaper. Alternatively, the scraper 68 can define a static, stationary blade extending substantially the entire length of the cathode drum 44.

The molten electrolyte 42 is comprised of a lithium chloride-potassium chloride (LiCl—KCl) eutectic mixture (LiCl:KCl=58.8:41.2 mol %), and uranium chloride ($UCl_3$, 4 to 6 wt. %). The operating temperature is above the LiCl—KCl eutectic melting-point temperature of ~360° C.

Preferably, the operating temperature ranges from about 475° C. to 525° C., and most preferably at ~500° C.

The applied voltage, the first voltage 52 supra, for uranium reduction ranges from about −0.5 volts (V) to −1.0 V. The other applied voltage, the second voltage 62 supra, for zirconium and noble-metal fission product reduction ranges from about −0.5 V to −1.5 V.

The invention exploits the phenomenon that the more negative the potential of a reaction, the less spontaneous the reaction. Specifically, a voltage or decomposition voltage (−0.8 V) of the cell is less negative (a lower absolute value) than a voltage of (−1.6). The negative values associated with the above example should be construed as applied or impressed voltage. Applied voltages can be controlled at a level so as to not oxidize other metals present in, for example, the electrorefiner 30. An example of the nonoxidation of other metals present in the electrorefiner 30 is that of iron (Fe). The anode potential resulting from the oxidation of iron ($Fe^0 \rightarrow Fe^{2+}$) is +0.49 V at 500° C. Thus, a negative applied voltage keeps iron in the metallic state.

Since the containment vessel 48, the cleanup vessel 64, first cathode 44, drive sprocket 54, anode baskets/plates 33, and mesh screen (not shown in FIGS. 2–4) are all made of ferrous metals, these parts will not be corroded at the aforementioned applied voltages.

Other actinides such as plutonium are not reduced at the first cathode 44, or the second cathode 64 for that matter, inasmuch as uranium is the most noble of the actinide metals. Once an actinide other than uranium is reduced at the first cathode 44, the relative chemical activities of the various actinide species causes the nonuranium actinide to be re-oxidized and a uranium ion such as $U^{3+}$ is reduced to metallic uranium, $U^0$. That is, the uranium ion serves as an oxidizing agent for the non-uranium actinide element which, in turn, reduces the uranium ion to uranium metal. This process is self-sustaining until the system is almost depleted of uranium. This allows for reduction of the uranium ions while the other actinide metal ion moieties are eventually transported to another electrorefiner cell. A reasonable level of purity is thus attained in the electrorefinement of the uranium, and subsequently, other metals.

The operation details below are meant only as an example of the instant invention and serve to illustrate its actual operation.

Operation Detail

Figure 1:
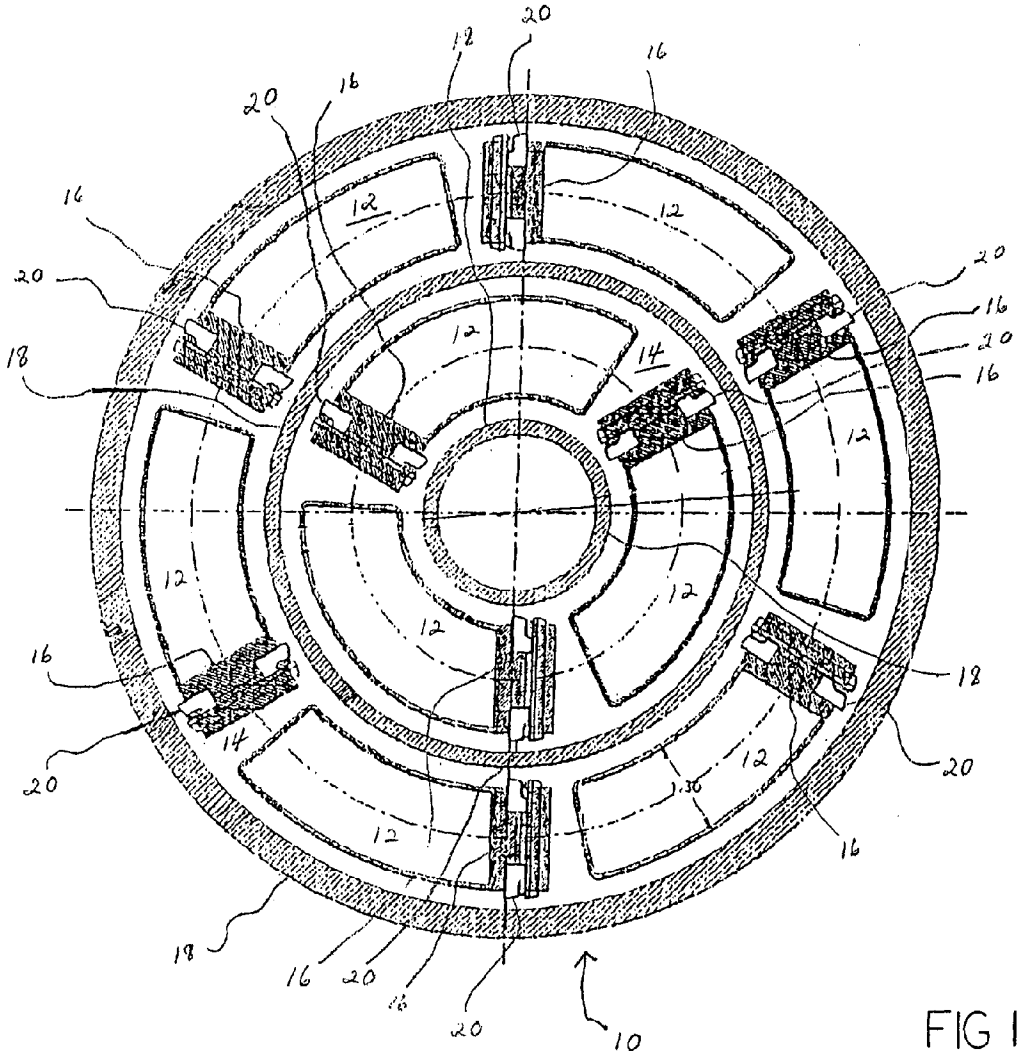
FIG. 1 is the schematic diagram of the cross-section of a contemporary electrorefiner.

In a preferred embodiment, the invention has a cathode, defining a cylinder having a diameter of ~1.7 meters (m), and a length of ~1.8 m [6 feet (ft)]. This cathode is immersed, perpendicular to its longitudinal axis to approximately half its diameter, into a semi-cylindrical vessel containing an electrolyte. The electrolyte is an eutectic mixture of lithium chloride and potassium chloride salts, and uranium chloride. The horizontal dimensions of the anode baskets or plates are approximately 1.8 m (6 ft) (the length of the cathode drum perpendicular to the plane of FIG. 1) by 10 centimeters (cm) to 20 cm (4 inches to 8 inches). The vertical dimension or depth of the baskets is defined by the weirs which have a height of approximately 1 cm.

The anodic drive sprocket is of the same length as the cathode and the anode baskets or plates. The diameter of the drive sprocket, as illustrated in FIG. 2 supra, is shown to be approximately half the diameter of the cathode drum. The actual diameter would depend upon engineering considerations.

The spent nuclear fuel is loaded along the direction of the shorter horizontal dimension of the segmented conveyor belt (i.e., perpendicular to the longitudinal axis of the conveyor belt and parallel to the belt's motion). This feature allows for straightforward scaleability to larger sizes for the device 30 in the other (transverse or perpendicular) directions.

Given the above dimensions, a bed of fuel ~1 centimeter (cm) thick can be passed around the cylinder 44 by a belt ~1 cm away from it. This bed of fuel occupies a volume of ~48,300 cubic centimeters ($cm^3$), contains a mass of ~483 kilograms (Kg) of chopped or shredded fuel at all times, and can be continually replenished. The bed moves at a speed of ~5 cm (2.15 in)/hour (hr), and is provided with an electrotransport current of ~3400 amperes (amps). Such a system, operated at a 75% capacity factor, has an annual processing rate of 65,700 kilograms per year (Kg/yr) or ~66 metric tons (MT) per year (yr) of spent metallic nuclear fuel.

The ~5 cm (2.15 in) per hr is a net forward speed of the belt, and can be accomplished by continuous forward motion or by back-and-forth motion with a longer forward than backward stroke. The back-and-forth belt motion provides agitation and stirring of both salt baths and consequent flow of the molten salts through the bed of shredded fuel. In addition, the back-and-forth motion levels the deposits of shredded fuel in the anode baskets at the front end of the device and process and aids in the removal of debris at the back end of the device.

The cathodic drum moves at a constant speed in a direction opposite to the direction of net movement of the belt.

Scale up to, for example, 100 MT/yr can be accomplished in a straightforward manner by increasing the length and/or diameter of the cathode cylinder and, correspondingly, the sizes of other components.

The invented process and device can be applied to any spent metallic nuclear fuel, especially those with uranium as one of even many major metal components.

The instant invention isolates the components of spent nuclear fuels, reduces the quantity of waste produced which has to be buried at sites for nuclear reactor wastes, and maximizes the yields of valuable metals such as uranium.

This invention also relates to an improved or enhanced electrochemical system which provides a means of metal reduction.

The actual physical dimensions of the electrorefiner, the individual cells and electrodes are governed by efficiency concerns, maximizing the effectiveness of uranium refinement.

A scraper that is isolated from the anode-to-cathode electrical circuit and is not immersed in the salt permits optimization for dendrite removal efficiency.

Loading of the fuel from above the anode compartments on the moving belt allows for straightforward scaleability of the electrorefiner up to larger sizes.

A thin anode bed in close proximity to the cathode allows maintenance of high electrochemical efficiency during equipment scale-up.

The device and process extracts elemental uranium metal from spent metallic nuclear fuel substrate at temperatures well below zirconium's melting point, 1852° C., and the melting points of fission product noble metals. More importantly, the extraction of uranium metal from the substrate also takes place at reduction potentials below those of zirconium and the noble metals. The other actinides do not get reduced at the cathode because uranium is the most noble of the metals found in the fuel. So, as soon as another actinide is reduced there, the relative chemical activities of the various species causes it to be reoxidized to its metallic form. This will continue until there is very little uranium in the system, at which time higher actinides will begin to be reduced.

The invented process and device can be applied to any spent metallic nuclear fuel. The invention isolates the components of spent fuels, reduces the quantity of waste produced which has to be buried at sites for nuclear reactor wastes, and maximizes the yields of valuable metals such as uranium. As discussed supra, this isolation is facilitated by providing a uranium deposition surface which moves in a direction opposite that of residual material from which the uranium is derived.

The process utilizes electrochemical separation based on the differences in metals' electrochemical properties, and a novel design for the separator/electrorefiner.

While the invention has been described with reference to details of the illustrated embodiment, these details are not intended to limit the scope of the invention as defined in the appended claims.

The embodiment of the invention in which an exclusive property or privilege is claimed is defined as follows:

1. A device for electrorefining uranium and other metals contained in spent metallic nuclear fuels, the device comprising:

a) a hopper positioned above a first containment vessel and having a means of passage to the containment vessel;

b) a first anode comprising the first containment vessel, a segmented belt, segment connectors, shredded nuclear fuel, and a drive sprocket in electrical communication wherein the segmented belt transports the fuel between the first and a second containment vessel;

c) a first cathode comprising a cylindrical drum suspended within an annular space of the first containment vessel;

d) a first electrolytic salt bath contained within the first containment vessel in electrical communication with the first anode and first cathode;

e) a second anode comprising the segmented belt and the drive sprocket in electrical communication;

f) a second cathode comprising the second containment vessel;

g) a second electrolytic salt bath in electrical communication with the second anode and second cathode;

h) a scraper for removing elemental uranium dendrites from the first cathode; and i) a receptacle for collecting the uranium dendrites.

2. The device as recited in claim 1 wherein the segmented belt in electrical communication with the first containment vessel comprises:

a) a perforated segmented belt, a mesh screen resting on and contacting the fuel carrying side of the belt;

b) interlocking segment connectors which define weirs of the belt segments; and, c) bristle containing brush tip attached to the outer surface of the connectors and in electrical communication with an inner surface of the first containment vessel.

3. The device as recited in claim 1 wherein uranium (III), $U^{3+}$, ions are reduced at the first cathode.

4. The device as recited in claim 1 wherein the second electrolytic salt bath is adapted to receive the segmented belt and is for cleaning.

5. The device as recited in claim 1 wherein the scraper is situated remote from the first electrolytic salt bath.

6. The device as recited in claim 5 wherein the scraper is made of a material selected from the group consisting of tool steel, silicon carbide, and tungsten carbide.

7. The device as recited in claim 1 wherein the segmented belt and first cathode rotate in opposite directions.

8. The device as recited in claim 1 wherein the anodes and cathodes are made from a heat tolerant material selected from the group consisting of low-carbon steel, ferritic stainless steel, stainless steel and alloys thereof.

9. The device as recited in claim 8 wherein the melting point (mp) temperatures of the heat-tolerant materials are above the temperatures of the electrolytic salt baths.

10. The device as recited in claim 1 wherein an annular space is between the first cathode and the segmented belt to accommodate the build up of uranium.

11. The device as recited in claim 1 wherein the segmented belt has porosity to allow uranium ions to migrate through the segmented belt to the first cathode.

12. The device as recited in claim 1 wherein a fine mesh screen rests on top of the segmented belt to prevent noble metal fission products and spent fuel matrix from reaching the first cathode.

13. The device as recited in claim 1 wherein a discharge receptacle is positioned under the segmented belt to receive debris.

14. The device as recited in claim 1 wherein the reduction potential of the first anode and cathode is below the reduction potential of zirconium and noble metals.

15. The device as recited in claim 1 wherein the temperature is below the melting points of zirconium and fission product noble metals.

16. The device as recited in claim 1 wherein the reduction potential of the second anode and cathode is above the reduction potential of zirconium and the noble metals.

* * * * *